US005988478A

United States Patent [19]

Marks

[11] Patent Number: 5,988,478

[45] Date of Patent: Nov. 23, 1999

[54] LIGHT DUTY, FORWARD ACTING STAPLING MACHINE

[75] Inventor: Joel Steven Marks, Los Angeles, Calif.

[73] Assignee: WorkTools, Inc., Chatsworth, Calif.

[21] Appl. No.: 09/078,995

[22] Filed: May 14, 1998

Related U.S. Application Data

[62] Division of application No. 08/694,815, Aug. 9, 1996, Pat. No. 5,765,742.

[51] Int. Cl.[6] ..... B25C 5/06

[52] U.S. Cl. ..... 227/132

[58] Field of Search ..... 227/134, 132, 227/120, 125, 126

[56] References Cited

U.S. PATENT DOCUMENTS

| | | | |
|---|---|---|---|
| 2,326,540 | 8/1943 | Krantz . | |
| 2,769,174 | 11/1956 | Libert | 1/49 |
| 3,862,712 | 1/1975 | LaPointe et al. | 227/127 |
| 4,119,258 | 10/1978 | Ewig, Jr. | 227/132 |
| 4,126,260 | 11/1978 | Mickelsson | 227/132 |
| 4,150,774 | 4/1979 | Wright | 227/132 |
| 4,225,075 | 9/1980 | Chi | 227/132 |
| 5,335,839 | 8/1994 | Fealey | 227/132 |
| 5,407,118 | 4/1995 | Marks | 227/132 |
| 5,497,932 | 3/1996 | Brewer et al. | 227/132 |

FOREIGN PATENT DOCUMENTS

| | | |
|---|---|---|
| 0 281 541 B1 | 5/1991 | European Pat. Off. . |
| 807937 | 1/1959 | United Kingdom . |
| 2 032 327 | 5/1980 | United Kingdom . |
| 2 229 129 | 9/1990 | United Kingdom . |

*Primary Examiner*—Scott A. Smith
*Attorney, Agent, or Firm*—Paul Y. Feng; Fulwider Patton Lee & Utecht, LLP

[57] ABSTRACT

A simplified fastening tool which uses the energy stored in a spring to install fasteners by an impact blow is disclosed. A housing body is preferably cast or molded. A one-piece plastic hand lever is pivotably attached to the body where the pivoting action is by sliding in a circular arcuate channel. A staple feeding track is slidably mounted to the bottom of the housing and includes a rear end element with forwardly extending resilient latching elements to secure the track. A hand grip opening extends forward up to the plunger and the hand lever is hinged at the rear of the housing.

14 Claims, 4 Drawing Sheets

LIGHT DUTY, FORWARD ACTING STAPLING MACHINE

This is a divisional application of application Ser. No. 08/694,815, filed on Aug. 9, 1996, now U.S. Pat. No. 5,765,742, entitled "Light Duty, Forward Acting Stapling Machine," whose entire contents are hereby incorporated by reference.

BACKGROUND OF THE INVENTION

1. Field of the Invention

The present invention generally relates to manually powered- fastening devices and specifically to impact driven staple guns and tacking machines.

2. Description of the Related Art

The fastening tool of the invention may use an operating principle similar to that disclosed in several U.S. patents, including U.S. Pat. No. 5,407,118 to Marks. In Marks, an operating handle is hinged at a rear end of the tool housing while a staple is ejected from the bottom front end. A staple feeding track slides rearward from the bottom of the tool body to expose a staple holding chamber. A releasable latch retains the track from sliding rearward.

U.S. Pat. No. 2,326,540 issued to Krantz discloses a staple gun in which a hand lever is pivoted at the back and an actuating lever is pivoted above the hand grip opening with a lifting end engaging the rear portion of a large plunger lifting assembly.

U.S. Pat. No. 2,769,174 issued to Libert discloses a staple gun in which a hand lever is pivoted at the back and an actuating lever is pivoted in front of the hand grip opening with a lifting end still further forward of the hand grip opening.

UK Patent Spec. No. 807 937 issued to Seimsen and Post discloses a staple gun in which a hand lever is pivoted at the rear end and an actuating wheel is located in front of the hand grip opening with lifting ends engaging a plunger in front of the wheel.

U.S. Pat. No. 3,862,712 issued to LaPointe et al. discloses a staple gun with a staple feeding track that slides rearward to expose a staple loading chamber. A releasable latch assembly retains the track in position.

U.S. Pat. No. 4,119,258 issued to Ewig Jr. discloses a staple gun with a body and hand lever constructed substantially of plastic material. U.S. Pat. No. 4,150,774 issued to Wright discloses a staple gun with a staple feeding track including a rearwardly cantilevered flexible latch.

European Patent Published Specification No. 0 281 541 B1, filed by B. Westerland discloses a staple gun with a hand lever pivoted near the front, a flat plunger, and a spring elongated rearward from the front.

U.K. Patent Application No. 2 032 327 A (Barrlendos) discloses a staple gun with a hand lever pivoted near the front, a flat plunger, and a coiled wire torsion spring elongated rearward from the front. The plunger center links to the spring and the plunger top links to the lever. Barrlendos shows a common design for a simplified staple gun. The tool is gripped from behind the lever pivot location and the hand tool occupies the rear portion of the tool body. Substantially front to back forces are generated upon the plunger as a result of angles at which the lever and spring engage the plunger and the large separation between the lever and the spring at the plunger.

U.K. Patent Application No. 2 229 129 A (Chang) discloses a desktop stapler with an actuating lever pivoted near the front and a hand lever pivoted at the rear. An elongated torsion spring is energized when the device is in the rest state. Pressing the hand lever immediately releases the plunger and spring. Chang does not teach any means for raising the plunger and re-energizing the spring.

None of the foregoing teach the making of a staple gun which may be gripped and operated at the front end. For example, both Libert and Krantz show a large vertical spring and plunger assembly that occupies a substantial portion of the front end of the tool. Chang discloses a desktop stapler with a permanently attached base and a solid sided housing. The method of operation differs from the present invention in that the spring is energized when the device is in an initial state. There is no mechanism to complete an operating cycle; in particular, there is teaching with respect to a structure to raise the plunger.

SUMMARY OF THE INVENTION

In a preferred embodiment, the present invention comprises a forward acting stapling device wherein the hand lever is hinged at the rear. However, most of the improvements of the present invention are equally useful when incorporated into a rearward acting stapling device wherein the hand lever is hinged toward the front of the tool.

In the preferred embodiment, an all plastic hand lever is pivotably attached to an optional, all plastic housing body. A circular arced extension from the end of the hand lever slidably engages a circular slot formed by walls of the housing body. The arced extension pivots around a post forming the top of the slot and slides atop a curved wall forming the bottom of the slot. This design provides a fully supported pivot for the hand lever through the required pivoting motion without the need for a hole passing through the hand lever. One advantage of this hinge concept is that the pivot point can be immediately adjacent to the housing edgewall allowing the longest practical handle within the confines of the tool body. If a hole is used through the handle, a wall of the handle fully surrounds the post so the post would need to be spaced farther inward from the edgewall to make room for the wall surrounding the hole.

Another advantage is that the pivot slot can be formed entirely from the material of a plastic housing while retaining substantial strength. The post and curved wall are extensions of the housing edgewall and get additional support from the edgewall as a result. In contrast, an isolated post through a hole in the handle would have only the housing sidewall for support.

A further substantial advantage of the present invention pivot slot design is that, in a preferred embodiment, the all plastic handle can be injection molded with the arced extension in a simple two-piece mold. A pivot hole requires a cross acting slide bar in the mold which complicates the manufacture of both the mold and the hand lever.

A staple feeding track is slidably mounted at the bottom of the housing body of the invention. A latching component features forward extending resilient arms which releasably latch to a rib of the housing body. The distal ends of the arms are biased to press outward against the internal sides of the housing body. To disengage the arms from the housing they are squeezed toward each other by pressing an exposed surface near the base of each arm, thus allowing the track to slide out. Sliding the track back into position under the housing causes the arms to snap into engagement with the housing.

U.S. Pat. No. 4,150,774 to Wright shows a rearward extending latching means typical of the prior related art.

Extension 33 of Wright is pressed to disengage a slidable element from the staple feeding chamber. Such a design is lengthwise inefficient since the extension must extend farther rearward from a portion of the staple chamber that is usable for staple storage and feeding. Extension 33 is pressed at its distal end while the latching occurs closer to the base. A relatively large pressing motion is therefore needed to disengage the latch. The area near extension 33 must be kept clear to allow this large motion.

In contrast, the latching arm of the present invention is cantilevered forward from the rear of the track. The arm is pressed between the base and the distal end. A relatively small motion at the pressing point produces a relatively large motion at the latching point. The overall motion of the latch remains limited so the latching elements can be coextensive with useable track length. The latches do not interfere, for example, with a spring biased staple pusher assembly or stored staples.

In this manner, an efficient staple storage and feeding assembly is obtained using a track of minimal length. In the preferred embodiment of the invention the rear end of the track is tucked under the tool body forming a smooth exterior rear surface. This smooth surface is possible since the improved design of the invention has the latches oriented forward into the tool body.

In the preferred embodiment of the invention, the hand lever is pivoted at a rear and uppermost practical location of the tool body using the pivot mechanism described above. An actuating lever links the hand lever to a plunger. The plunger is a substantially flat sheet metal form within a narrow vertical channel of the tool housing.

A coiled torsion spring links to the plunger immediately below where the actuating lever links to the plunger. In an initial condition the actuating lever engages the plunger at a substantial angle. This angle causes a large forward bias upon the plunger in addition to the desired upward bias provided by the lever. This angle is known in the art as disclosed in, for example, Barrlendos to allow rotation of the lever. But in the Barrlendos stapler, there is no way to counter the forward bias from the lever. For example, if the spring of the Barrlendos stapler is angled to pull back as it pulls in the desired downward direction upon the plunger to counteract the lever, the substantial vertical separation between the spring and lever at the plunger generates a friction inducing front to back torque upon the plunger. Therefore, Barrlendos does not disclose a solution to this friction problem.

A hand grip opening extends to a front end just beyond the plunger.

The forwardly gripped, forwardly acting design of the preferred embodiment provides the advantage that the hand lever is pressed and the tool is griped from a position substantially directly above the staple exit location. The staple can be pressed in with an action similar to that of a desk top stapler.

DETAILED DESCRIPTION OF THE INVENTION

In the following description, numerous details such as specific materials and configurations are set forth in order to provide a more complete understanding of the present invention. But it is understood by those skilled in the art that the present invention can be practiced without those specific details. In other instances, well-known elements are not described explicitly so as not to obscure the present invention.

Figure 1:
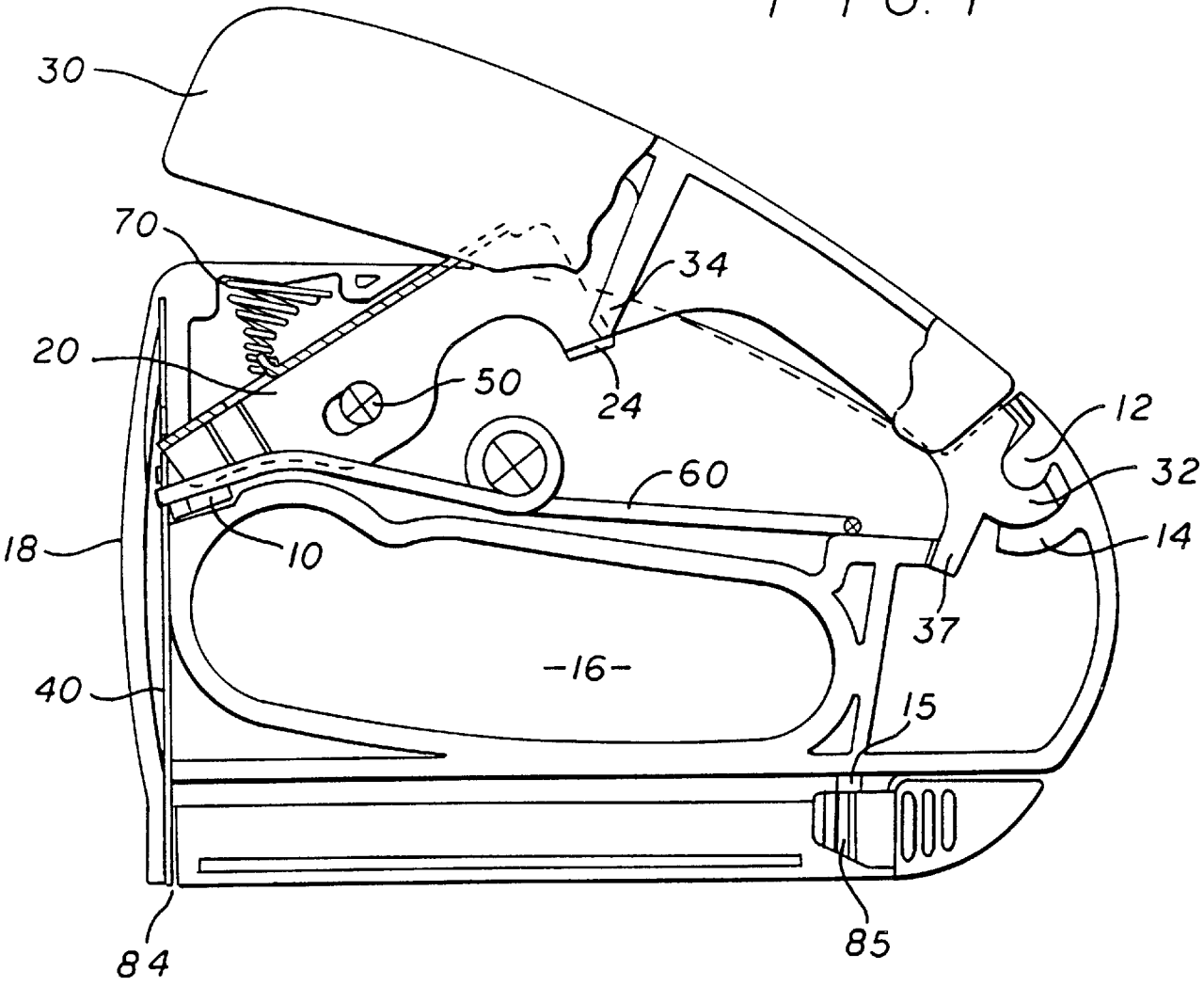
FIG. 1 is a side elevational view of a preferred embodiment staple gun, shown in a partial sectional view, of the present invention in an initial configuration.
Figure 3:
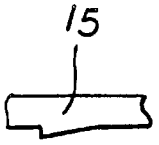
FIG. 3 is a sectional view of a staple gun housing showing a latching element.

FIG. 1 shows all the essential elements of the present invention. Housing body 18 is shown with one half removed to expose the internal components. Staple exit chamber 84 is the lower portion of a thin vertical channel within housing 18. Plunger 40 is vertically movable within the vertical channel.

Figure 7:
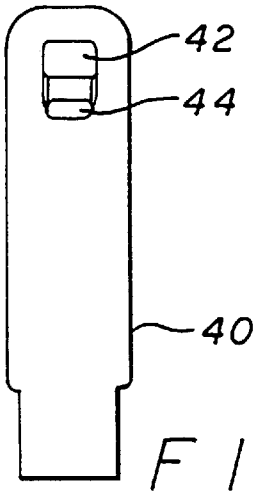
FIG. 7 is a rear elevational view of the plunger of FIG. 6.

Power spring 60 provides a downward bias upon plunger 40 while the downward motion of the spring and plunger assembly is limited by shock absorber 10. Actuating lever 20 is slidably, pivotably mounted to pin 50. Lever 20 and spring 60 engage plunger 40 at slots 42 and 44 respectively, as best seen in FIG. 7.

Hand lever 30 is pivotably mounted to housing 18 below pivot 12 and above rib 14. In a preferred embodiment, this pivot location is at the rear of housing 18, but in an alternative embodiment (not shown), hand lever 30 may be pivoted at the front of housing 18. Return spring 70 provides a reset bias to actuating lever 20 and hand lever 20.

Rib 34 of hand lever 30 slidably and pivotably engages tab 24 of actuating lever 20. Extension 37 of hand lever 30 is a stop to limit travel of hand lever 30.

Figure 2:
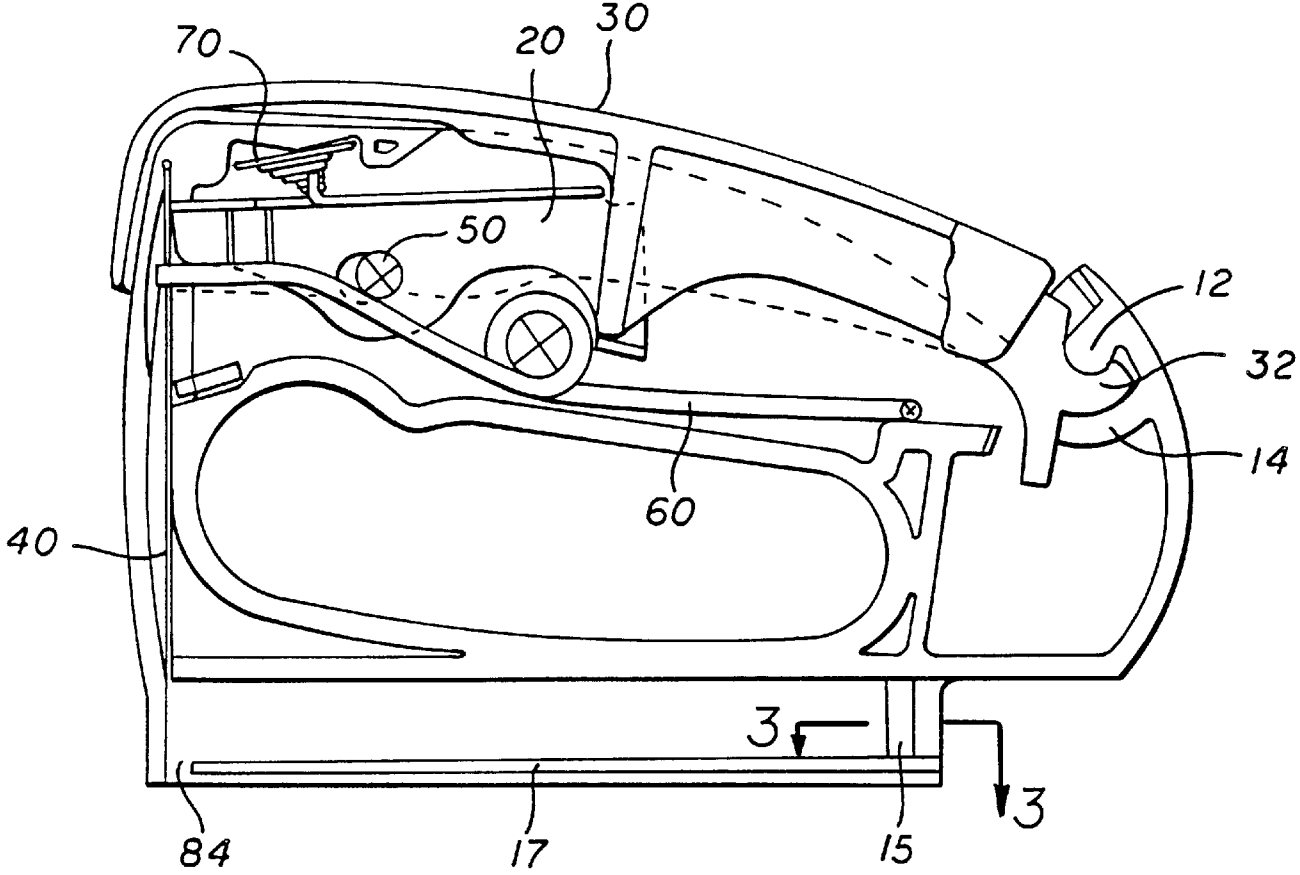
FIG. 2 is another side elevational view of the staple gun of FIG. 1, just prior to ejection of a staple.
Figure 5:
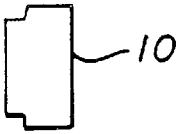
FIG. 5 is a plan view of a shock absorber element.
Figure 8:
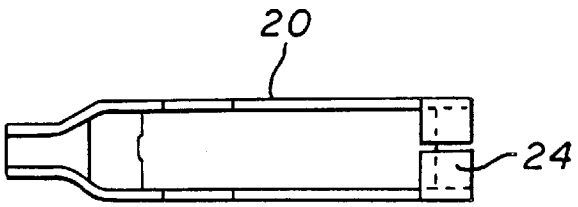
FIG. 8 is a bottom plan view of an actuating lever.

As hand lever 30 is pressed down, actuating lever 20 lifts plunger 40 to the position shown in FIG. 2. As a result of the arcing motion about pin 50, lever 20 disengages plunger 40. The plunger 40 and power spring 60 assembly instantly moves downward to eject a staple from staple exit chamber 84. Return spring 70 exerts a downward and forward bias on actuating lever 20 in FIG. 1 so that actuating lever 20 re-engages slot 42 of plunger 40.

The locations of pivot 12, tab 24 and pin 50 are aligned at an intermediate rotational position of hand lever 30. At this condition there is no sliding between rib 34 and tab 24. There is sliding when tab 24 is above and below this point, but the sliding is minimized when tab 24 stays as close as possible to the aligned condition. It is therefore not essential that a roller linkage be used to reduce friction between hand lever 30 and lever 20 at tab 24.

Figure 4:
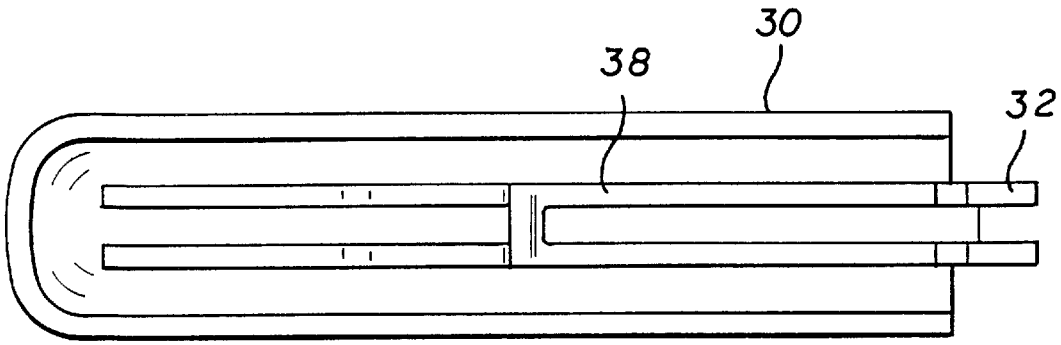
FIG. 4 is a bottom plan view of a staple gun hand lever.

Hand lever 30 has circular, arced extensions 32 as seen in FIGS. 1 and 4. These segments are extensions of stiffening ribs 38 within hand lever 30. Since ribs 38 engage pivot 12 directly through extensions 32, hand lever 30 is pivoted most rigidly to housing 18.

Figure 6:
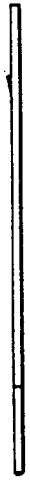
FIG. 6 is a side elevational view of a plunger.
Figure 9:
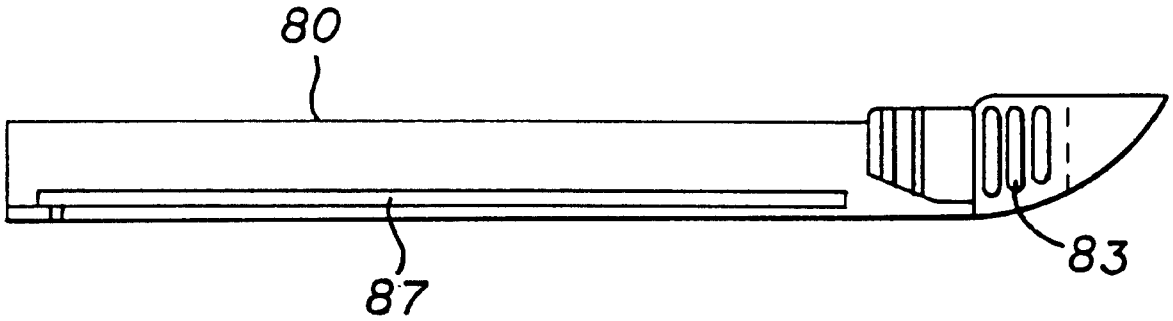
FIG. 9 is a side elevational view of a staple feeding track and latching assembly.
Figure 10:
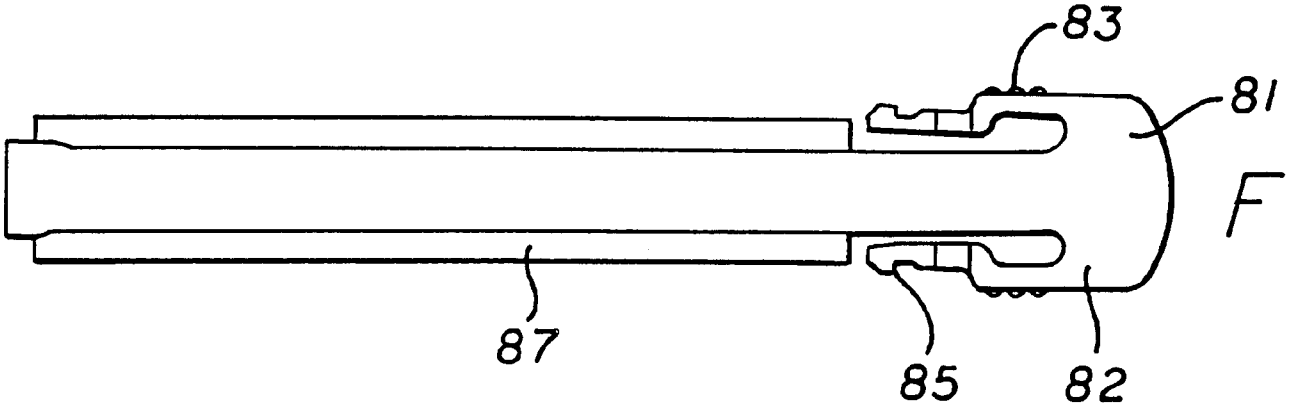
FIG. 10 is a bottom plan view of the assembly of FIG. 9.

Plunger 40 is preferably a thin sheet metal form that is substantially flat except for small out-of-plane features which may be incorporated as a design choice. For example, between slots 42 and 44, an out-of-place web is visible (FIGS. 6 and 7) to provide clearance for the front end of lever 20. A completely flat plunger 40 may also be used.

Lever 20 directly engages flat plunger 40 at a location substantially directly above hand grip opening 16. The hand grip opening extends forward to immediately adjacent to plunger 40.

Feeding track 80 has a spring biased pusher not shown, which biases staples forward upon track 80 in a conventional way. End 81 has attached latching arms 82 which further have detent latches 85 at a forward distal end. End 81 may be integral with, or alternately separately attached to, track 80. Track 80 has flanges 87 to slidably engage channels 17 of housing 18.

To expose a staple holding chamber within housing 18, track 80 slides rearward from under housing 18. To disengage latch 85 from detent rib 15, ribbed surfaces 83 of resilient latch arms 82 are pressed inward. Track 80 is then free to slide rearward. Sliding track 80 forward in position under housing 18 causes ramps of rib 15 and latch 85 to deflect and allow re-engagement of latch 85 against rib 15.

When track 80 is closed, end 81 forms, in a preferred embodiment, a smooth surface at the rear to blend and match the rear end of housing 18. This is possible because the latching elements are hidden within the staple holding chamber of housing 18. Further, this design is desirable in the preferred embodiment forward acting design to enhance the appearance that end 81 is a rear end.

However, the improvements of the invention comprising the hand lever pivot and the track latch are also beneficial to a conventional rearward acting staple gun when a smooth, compact and low cost design are desired.

What is claimed is:

1. A fastening device comprising:

a housing body to support and guide functional components;

a fastener guide track attached to the housing near a bottom thereof, to guide fasteners toward a front of the housing;

a plunger located at a front of the housing, the plunger oriented to expel objects on the fastener guide track out of the fastening device through a fastener exit slot;

a spring linked to the plunger, oriented to force the plunger toward the bottom of the housing;

an actuating lever linked to the plunger and pivotably attached to the housing body of a first pivot so that rotation of the actuating lever causes lifting of the plunger within a channel of the housing body, the channel above and aligned with the exit slot;

a hand lever linked to the actuating lever at a location rearward of the first pivot, the hand lever pivotably attached to the housing body at a second pivot rearward of the hand lever to actuating lever link location;

the plunger comprising a thin, flat sheet metal form;

a front distal end of the actuating lever engaging the plunger through an opening in the plunger;

the spring elongated and extending from the plunger toward a rear of the housing body and pivotably pressing a spring fulcrum element within the housing body;

a hand grip opening through said housing body elongated from a closed front end and extending rearward, and located below said spring;

the hand lever having a first end substantially above the plunger and a rear end near the second pivot, the hand lever pivoting from an initial position toward the housing such that the hand lever front end rotates substantially directly toward the exit slot.

2. The fastening device of claim 1, wherein said hand grip opening closed front end is immediately adjacent to said plunger.

3. The fastening device of claim 2, wherein said actuating lever and said elongated spring are positioned entirely above said hand grip opening.

4. The fastening device of claim 3, wherein said actuating lever has a U shaped transverse cross-section including a top face and two side walls wherein a portion of said spring is substantially parallel to the actuating lever and is between the two side walls.

5. A method for installing at least one fastener into a substrate by impact blow comprising the steps of:

providing a housing having a hand grip opening, a bottom, and a front;

attaching a fastener guide track to the housing near the bottom thereof;

urging the fastener inside the fastener guide track toward the front of the housing;

locating a plunger at the front of the housing;

orienting the plunger to expel the fastener out of the housing through a fastener exit slot;

providing a spring within the housing above the hand grip opening;

linking the spring to the plunger so that the plunger is biased toward the bottom of the housing;

providing an actuating lever within the housing above the hand grip opening;

rotating the actuating lever about a first pivot within the housing, wherein a front end of the actuating lever engages the plunger proximate to the spring and lifts the plunger within a channel of the housing above the exit slot;

rotating a hand lever about a second pivot rearward of the first pivot, wherein a front end of the hand lever rotates downward toward the exit slot;

linking the hand lever to the actuating lever at a location between the first and the second pivots so that as the hand lever rotates downward, the actuating lever raises the plunger;

constraining the spring to an elongated form extending from the plunger rearward toward the back of the housing and pivoting the spring about a spring fulcrum within the housing body; and squeezing the hand lever so that the front end of the hand lever rotates toward the exit slot to a pre-determined position and the actuating lever disengages the plunger, the plunger urged by the spring to drive the fastener by impact into the substrate.

6. The method according to claim 5, wherein a the method further comprises the step of bending a front position of the spring downward so that the spring partially surrounds a top and front of the hand grip opening.

7. The method according to claim 5, wherein the method further comprises the steps of providing the actuating lever with a U-shaped traverse cross-section; and positioning the actuating lever over the spring so that the actuating lever partially surrounds the spring.

8. The method according to claim 5, wherein the step of squeezing the hand lever further comprises providing an intermediate position for the hand lever defined by an alignment of the front end of the actuating lever, the first pivot, and the hand lever to actuating lever linkage.

9. A fastening device comprising:

a housing having a front, a bottom, and a rear;

a fastener guide track attached to the housing near the bottom thereof, to guide fasteners toward the front of the housing;

a plunger located at the front of the housing, the plunger oriented to expel objects from the fastener guide track out of the fastening device through a fastener exit slot, wherein the plunger includes a thin, flat sheet metal form, elongated from a top to a bottom;

a spring fulcrum element within the housing;

a spring linked to the plunger, oriented to force the plunger toward the bottom of the housing, wherein the spring is elongated and extends from a second opening in the plunger toward a rear of the housing and pivotably presses the spring fulcrum element;

an actuating lever linked to the plunger and pivotably attached to the housing at a first pivot so that rotation of the actuating lever lifts the plunger within a channel of the housing, wherein the channel is disposed above and aligned with the exit slot;

a hand lever linked to the actuating lever at a location rearward of the first pivot, the hand lever pivotably attached to the housing at a second pivot rearward of the hand lever to actuating lever link location;

a front distal end of the actuating lever engaging the plunger through a first opening in the plunger;

a hand grip opening through the housing, elongated from a closed front end and extending rearward;

a segment of the spring between the plunger and the spring fulcrum bent downward so that the spring partially surrounds the closed front end of the hand grip opening; and the hand lever having a first end substantially above the plunger and a rear end near the second pivot, the hand lever pivoting from an initial position toward the housing such that the hand lever front end rotates substantially directly toward the exit slot.

10. The fastening device of claim 9, wherein the hand grip opening closed front end is immediately adjacent to the plunger.

11. The fastening device of claim 9, wherein the actuating lever and the elongated spring are positioned entirely above the hand grip opening.

12. The fastening device of claim 9, wherein the actuating lever has a U-shaped transverse cross-section including a top face and two side walls, wherein a portion of the spring is substantially parallel to the actuating lever and is between the two side walls, the first opening and the second opening in the plunger proximal on a length of the plunger.

13. The fastening device of claim 12, wherein the actuating lever links to the plunger by pressing upward and forward within the first opening in an initial position, the spring links to the plunger by pressing downward and rearward within the second opening in an initial position the net force upon the plunger being substantially completely in a lengthwise direction on the plunger.

14. The fastening device of claim 9, wherein the hand grip opening front end has a recess in a top face so that the top face is spaced from the fastener guide track at the front end of the hand grip opening.

* * * * *